United States Patent [19]

Champagnac, Paul R.

[11] Patent Number: 4,898,401

[45] Date of Patent: Feb. 6, 1990

[54] DEVICE FOR PREVENTING BACKWARD MOVEMENT FOR SKIS

[75] Inventor: Champagnac, Paul R., Unieux, France

[73] Assignee: Mecanique Generale J. DeVille Et Cie, Aurec-Sur-Loire, France

[21] Appl. No.: 196,117

[22] Filed: May 13, 1988

[30] Foreign Application Priority Data

May 15, 1987 [FR] France ..... 87 07099

[51] Int. Cl.[4] ..... A63C 7/10

[52] U.S. Cl. ..... 280/605

[58] Field of Search ..... 280/605, 604

[56] References Cited

U.S. PATENT DOCUMENTS

| | | | |
|---|---|---|---|
| 3,899,184 | 8/1975 | Haddad | 280/605 |
| 4,333,667 | 6/1982 | Leichtfried et al. | 280/605 |
| 4,453,731 | 6/1984 | Krob | 280/605 |

FOREIGN PATENT DOCUMENTS

| | | | |
|---|---|---|---|
| 0159277 | 10/1985 | European Pat. Off. | 280/605 |
| 1179844 | 10/1964 | Fed. Rep. of Germany | 280/605 |
| 984272 | 7/1951 | France | 280/605 |
| 1010468 | 6/1952 | France | 280/605 |
| 2444478 | 7/1980 | France | 280/605 |

*Primary Examiner*—David M. Mitchell

*Attorney, Agent, or Firm*—Browdy & Neimark

[57] ABSTRACT

A device for preventing backward movement of skis comprising a flap hinged on a crosswise pin carried by a lug solidly connected with the ski; two bent and counterbent lateral arms having ends, shaped like pivot pins, which are mounted in rotation in bores of said flap around a pin placed in a longitudinal plane; a lock for locking the arms above the ski in an inactive position; and a device for bringing the arms from the inactive position to an active position in which they extend laterally with respect to the ski, this device including a control rocker able to pivot between a front and a back position around a horizontal crosswise pin placed in front of the flap pin, an elastic pusher connected to the control rocker having a notched free end which, when the control rocker is brought into the back position, covers a crosswise nose projecting from the front end of the flap and causes the flap to pivot so as to raise the arms relative to a locking cradle on the ski, and a spring for separating the arms in the active position.

6 Claims, 4 Drawing Sheets

DEVICE FOR PREVENTING BACKWARD MOVEMENT FOR SKIS

BACKGROUND OF THE INVENTION

1. Field of the Invention

The present invention relates to a device for preventing backward movement of skis.

2. The Prior Art

French patent No. 84 04333 (publication No. 2,561,113) relates to a device made up of a flap hinged on a crosswise pin carried by a lug solidly connected with the ski. Two bent and counterbent lateral arms have front ends, shaped like pivots pins, mounted in rotation in bores of the flap around a pin placed in a longitudinal plane. Means are provided for locking the arms on the ski in an inactive position and for bringing the arms from the inactive position to an active position in which they extend laterally with respect to the ski.

In the inactive position, the device is locked with its arms placed above the ski and in the backward direction of the latter. To bring it into the active position, it suffices to operate the locking means of the device to release these arms which, at a first time, pivot laterally on both sides of the ski relative to the flap, then, at a second time, pivot at the same time as the flap so that the end of their back part constituting a crampon comes in contact with the underlying snow or ice. In this way, when the wearer rests on one of the skis to advance the other ski to climb a slope, the supporting device for preventing backward movement receives all the reaction of the advancing effect of the other ski and pivots relative to the ski until the intermediate parts of the lateral arms come in contact with the ski and transmit to the latter a part of the resistant force which, otherwise, would run the risk of damaging the device or its pivoting mechanism.

This device is entirely satisfactory and enables the skier to climb steeper slopes than skins or other equivalent means. However, the means for recalling the arms, that is, returning them to their original position described in the two embodiments of this patent prove to be complex and burdensome because of the numerous parts that make them up.

SUMMARY OF THE INVENTION

The present invention provides a new embodiment making it possible to obtain superior results with a simpler and less burdensome structure, both in regard to the number of parts and to their assembly.

For this purpose, the means for bringing the arms from their inactive position to their active position consist, on the one hand, of a control rocker which is able to pivot between two positions, front and back, respectively, around a horizontal crosswise pin placed in front of the flap pin, and is solidly connected with an elastic pusher whose notched free end is able, when the rocker is brought into the back position, to cover a crosswise nose projecting from the front end of the flap and to make this flap pivot in the raising direction of the arms relative to a locking cradle on the ski. Spring means are provided for separating the arms in the active position.

Because of this arrangement, and depending on the front or back position given to the rocker, the arms can be brought from their neutral transport position at rest in the cradle to their separated position, then, by swinging of the rocker in the opposite direction, to their functioning position for preventing backward movement.

Advantageously, the pusher has a width less than the space between the two heads of the pivot pins, so that, when the arms are in the active position and the rocker is brought to the back position, the pusher comes in front of the nose of the flap to form an elastic holding element for the arms then constituting descent brakes.

Thus, the device for preventing backward movement, enabling the skier to climb slopes without skins, can also be used as descent brakes.

BRIEF DESCRIPTION OF THE PRESENT INVENTION

Other characteristics and advantages will come out from the following description with reference to the accompanying diagrammatic drawing representing by way of nonlimiting examples an embodiment of the device, in which.

DETAILED DESCRIPTION OF THE PREFERRED EMBODIMENT

Figure 1:
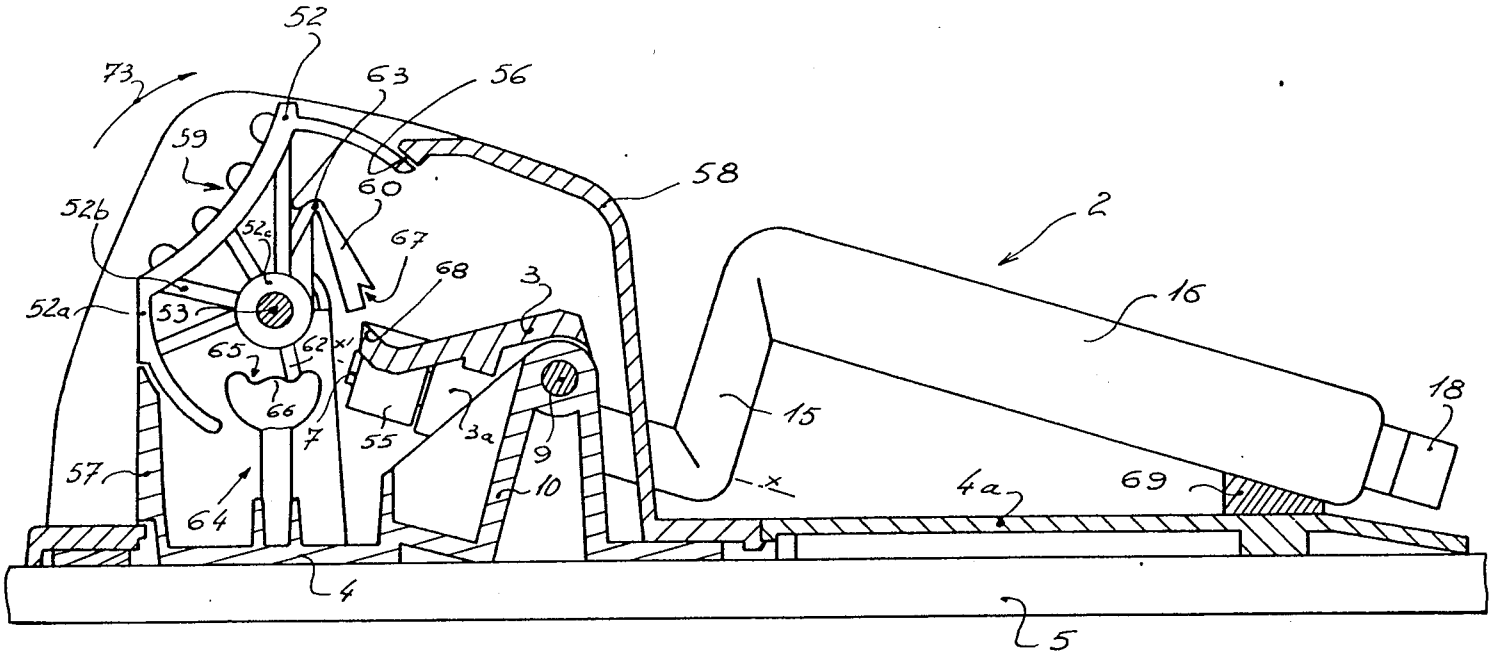
FIG. 1 is a side view in longitudinal section of the device when it is in neutral transport position.

The device according to the present invention comprises two lateral arms 2 mounted to pivot by their pivot pin 7 in flap 3 hinged on a crosswise pin 9 carried by a lug 10. Pivot pins 7 have longitudinal axes x'-x which are parallel to the longitudinal median plane of ski 5 on which the device is mounted. Lug 10 is solidly connected with a fastening base plate 4 connected to ski 5. Flap 3 consists of a U-shaped part having lateral wings 3*a* which are provided with a bearing for pivot pin 7 and are passed through by a crosswise bore (not shown) which receives hinge pin 9. Each pivot pin 7 is connected by an intermediate part 15, bent relative to it, to a counterbent back part 16 forming a blade and whose end is provided with a nose 18.

Figure 2:
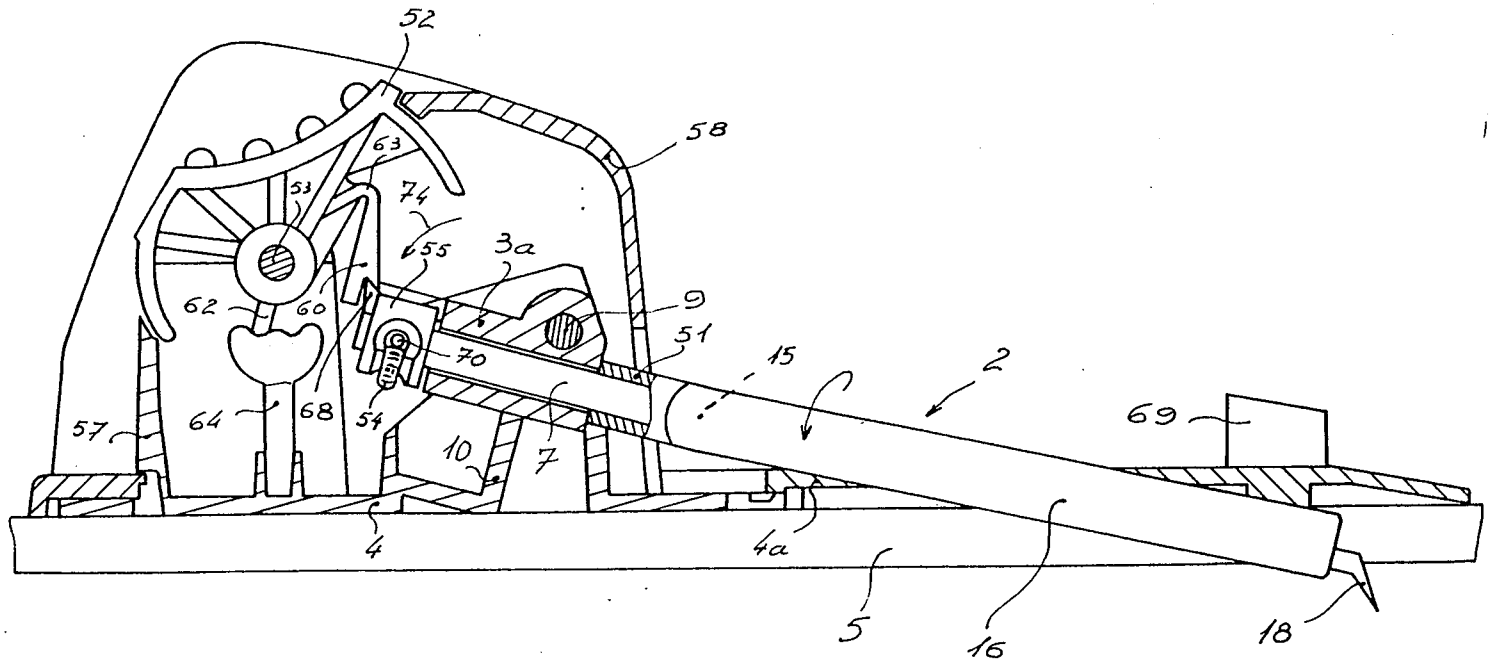
FIG. 2 is a side view, in section going through the most forward pivot pin, showing the device, according to the present invention when it is in the position for preventing backward movement at rest.

As shown in FIG. 2, each arm 2 is covered, beyond its part constituting pivot pin 7, by a sheath 51, molded on it to give it a blade shape at least in back part 16.

According to the invention, the means for bringing the arms from their active position to their inactive position consist, on the one hand, of a control rocker 52, hinged around a horizontal crosswsie pin 53 placed in front of pin 9 and, on the other hand, of biasing means 54 connecting heads 55 fastened to the end of pivot pins 7.

As the figures show, rocker 52 is made of molded synthetic material and exhibits the shape of a crown segment 52*a* connected by arms 52*b* to a hub 52*c*. This rocker swings through an opening 56 made between a crosswise wall 57 of base plate 4 and a cap 58 attached to this base plate. In its upper part, it comprises a grooved or notched support face 59 enabling it to be operated manually or with the end of a ski pole. This rocker is solidly connected with a pusher 60 and a radial lever 62. Pusher 60 is connected to it by a thinned zone 63 constituting an elastic hinge. Lever 62 works with means 64 assuring elastic locking of the rocker in each of its two positions, i.e., its front position represented in FIG. 1 and its back position represented in FIG. 2.

In the embodiment shown, these locking means consist of a stirrup-shaped stationary spring exhibiting, opposite radial lever 62, two notches 65 separated by an elastically deformable undulation 66. This spring is made of synthetic material or steel wire.

At its free end, pusher 60 is provided with a notch 67 intended to engage a nose 68 formed at the front end of flap 3.

Figure 5:
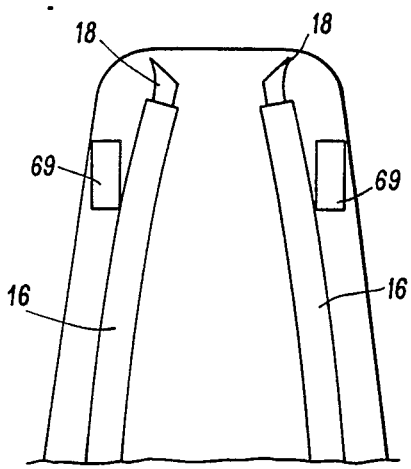

Finally, extension 4*a* of base plate 4 is provided with a cradle 69 comprising notches for positioning arms 2 when they are in the neutral transport position, represented in FIG. 1 and schematically shown in FIG. 5.

As shown in greater detail in FIG. 2, each of heads 55 of pivot pins 7 is provided with means 70, such as a stud engaged in a bore of the head, making it possible to hook one of the ends of crosswise spring 54, common to the two heads and constantly biasing arms 2 into active position, i.e., in the separated position on both sides of ski 5.

To bring the device from its neutral transport position to its active position, it is necessary, at a first time, to make rocker 52 pivot in the direction of arrow 73 of FIG. 1 to bring it from its front position, represented in this figure, to its back position, represented in FIG. 2. During this pivoting, notch 67 of pusher 60 comes to cover or engage nose 68 of flap 3 and causes the pivoting of this flap 3 and arms 2 in the direction of arrow 74 of FIG. 2. Under the effect of this pivoting, the back ends of arms 2 escape from the notches of cradle 69 and, under the action of spring 54, pivot around their pivot pin 7 bringing their blade-shaped part 16 on both sides of ski 5, as shown in FIG. 2.

Figure 3:
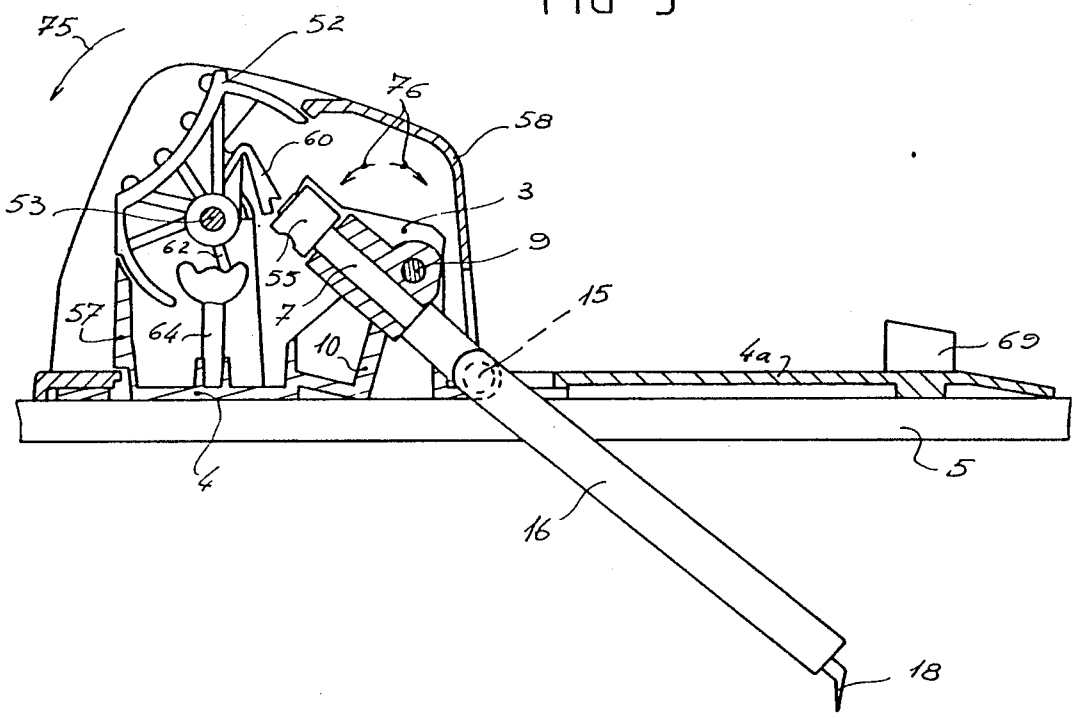
FIG. 3 is a view similar to FIG. 2 showing the device when it is in the device for preventing backward movement position.

It should be noted that in this position, arms 2 are in the position to prevent backward movement but cannot assure this function since they are immobilized by pusher 60 opposing the elevation of flap 3. To bring these arms into the backward movement prevention position represented in FIG. 3, it is necessary to bring rocker back into its front position by making it pivot in the direction of arrow 75 of FIG. 3. This pivoting has the effect of removing notched end 67 of pusher 60 relative to nose 68 of lever 3 which can thus pivot freely in the direction of arrows 76, allowing the movement of arms 2. FIG. 3 further shows that, as in the afore-mentioned patent, when arms 2 are used, they rest on ski 5 by their intermediate part 15 which absorbs the essential part of the reaction force and therefore reduces the force transmitted to pin 9 and to lug 10 by flap 3.

Thus one can see from above discussion that the locking device according to the invention requires a small number of parts which are easy to assemble and which lead to a much lower cost than that of the known device.

Figure 4:
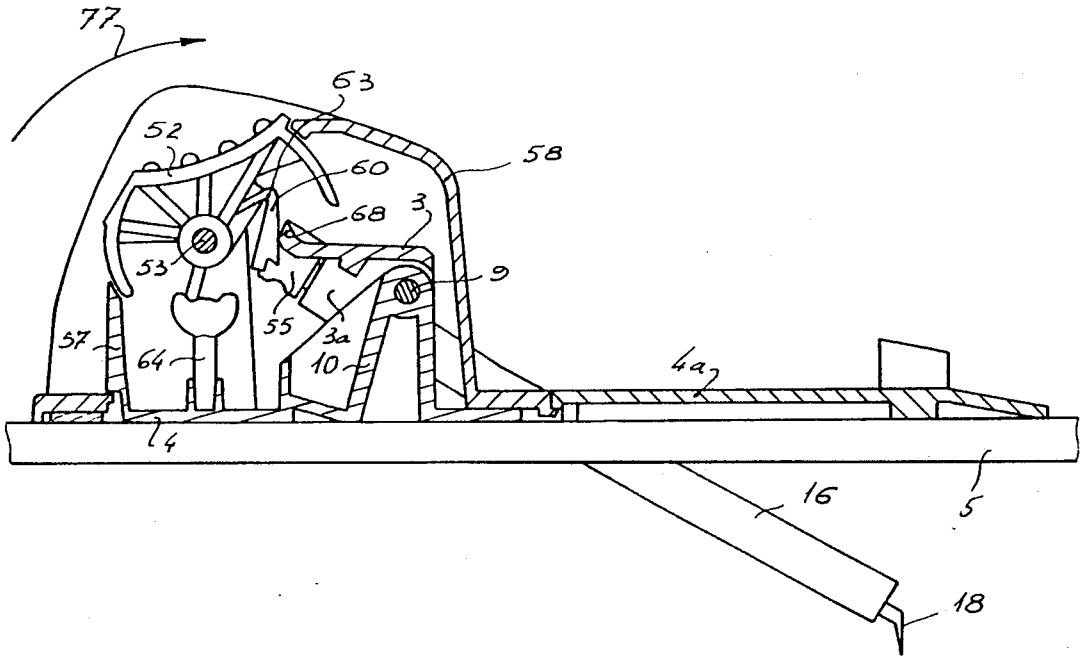
FIG. 4 is a view similar to FIG. 1 showing the device when it is in the descent brake position and FIG. 5 is a top view of the cradle for holding the arms in an inactive position.

Moreover, and as is shown in FIG. 4, this device can be used as a descent brake, i.e., as means of braking of the skis worn by the skier.

For this purpose, pusher 60 whose width is less than the space between the two heads 55 is brought in front of nose 68 of flap 3 by pivoting of rocker 52 in the direction of arrow 77 of FIG. 4 when arms 16 are in the active position.

Thus, when ends 18 of arms 16 are subjected to forces tending to lift them upward, the flap rests on pusher 60 which, because of the elasticity of its hinge 60, acts as an elastic shock absorber and allows the movement of these arms as a function of the resistance they encounter, without disturbing the braking which remains steady.

To bring the arms back in rest position, rocker 52 is pivoted in the direction of arrow 75 of FIG. 3, which has the effect of separating pusher 60 from heads 55 and lever 7. Then the two arms 2 are manually grasped bringing them close to one another by pivoting above the ski against spring 54 and finally lowering them until their back ends engage in cradle 69.

This device for preventing backward movement thus achieves results superior to those of the known device.

I claim:

1. A device for preventing backward movement for skis, comprising:

a lug adapted to be solidly connected with the ski carrying a transverse first pin;

a flap hinged on said first pin and having bores and a transverse nose projecting from a front end thereof;

two bent and counterbent lateral arms disposed on the opposite side of said first pin from said nose and having ends forming pivot pins which are mounted in rotation in the bores of said flap so as to pivot around an axis of a longitudinal plane with respect to the ski;

lock means spaced from said flap longitudinally along the ski and forming a cradle on the ski for receiving said arms therein and locking said arms above the ski in an inactive position; and movement means for bringing said arms from the inactive position to an active position in which said arms extend laterally and downwardly with respect to the ski, said movement means comprising:

a second horizontal transverse pin disposed in front of said first pin;

a control rocker pivotally mounted on said second pin so as to pivot between a front position and a back position;

an elastic pusher connected to said control rocker having a notched free end which covers and applies force against said nose of said flap when said control rocker is brought into the back position and which causes said flap to pivot so as to raise said arms relative to said lock means and allow said arms to escape from the cradle formed by said locking means; and spring means for separating said arm in the active position.

2. The device according to claim 1, wherein said pusher is connected to the rocker by a thinned zone constituting an elastically deformable hinge.

3. The device according to claim 1, further comprising a radial lever connected to said rocker and elastic means adapted to work with said radial lever for locking said rocker in the two positions.

4. The device according to claim 3, wherein said elastic means for locking the rocker comprises a stirrup-shaped stationary spring exhibiting, opposite the radial lever, two notches separated by an elastically deformable undulation.

5. The device according to claim 1, wherein each of the pivot pins of said arms is connected to a head constituting a hooking element for one of the ends of said spring means for biasing the arms into the active position.

6. The device according to claim 5, wherein said pusher has a width less than the space between the two heads of the pivot pins, such that, when said arms are in the active position and said rocker is brought to the back position, said pusher is disposed in front of said nose of said flap to form an elastic holding element then constituting descent brakes.

* * * * *